US005503459A

United States Patent [19]

White

[11] Patent Number: 5,503,459

[45] Date of Patent: Apr. 2, 1996

[54] WHEELCHAIR BACK FOR KYPHOTIC PATIENTS

[76] Inventor: Carol White, R.R. #1, Red Deer, Alberta, Canada, T4N 5E1

[21] Appl. No.: 287,280

[22] Filed: Aug. 8, 1994

[30] Foreign Application Priority Data

Aug. 17, 1993 [CA] Canada ..... 2104271

[51] Int. Cl.[6] ..... A47C 7/20

[52] U.S. Cl. ..... 297/452.33; 297/440.2

[58] Field of Search ..... 297/452.33, 452.29, 297/452.3, 452.31, 452.32, 440.2, DIG. 4, 452.28, 452.18, 452.1, 464, 440.1, DIG. 1, 284.1, 284.3, 284.4, 284.5; 280/250.1, 304.1; 128/870; 602/19

[56] References Cited

U.S. PATENT DOCUMENTS

| | | | |
|---|---|---|---|
| 2,582,115 | 1/1952 | Goodeve | 297/452.33 X |
| 3,197,255 | 7/1965 | Caudill | 297/284.1 X |
| 3,205,010 | 9/1965 | Schick | 297/284.1 X |
| 4,347,840 | 9/1982 | Adams | 297/284.3 X |
| 4,732,426 | 3/1988 | Brudermann et al | 297/452.33 X |
| 4,752,982 | 6/1988 | Jones et al. | 297/284.1 X |
| 4,835,801 | 6/1989 | Walpin et al. | 297/452.33 X |

FOREIGN PATENT DOCUMENTS

| | | | |
|---|---|---|---|
| 154582 | 9/1985 | European Pat. Off. | 297/452.33 |
| 2535591 | 5/1984 | France | 297/452.33 |

*Primary Examiner*—Milton Nelson, Jr.
*Attorney, Agent, or Firm*—Terry M. Gernstein

[57] ABSTRACT

There is provided a wheelchair back support adapted to specifically meet the requirements of a kyphotic patient. The support comprises an outer shell formed of a firm, pliable fabric. An inner foam padding is inserted within the outer shell. Two, longitudinally extending, resilient spaced-apart ribs are positioned at predetermined distances within the outer shell. The back is top stitched along its outer perimeter at a predetermined distance from the edge thereof to thereby achieve the specified shape.

3 Claims, 2 Drawing Sheets

WHEELCHAIR BACK FOR KYPHOTIC PATIENTS

FIELD OF THE INVENTION

The present invention relates to a wheelchair back support specifically designed for patients suffering from kyphosis.

BACKGROUND OF THE INVENTION

Kyphosis, often referred to as hunchback, is a common part of the aging process and the condition in the elderly is usually accompanied by a flattening in the lumbar area and a generalized rigidity of the entire back together with a generalized weakening throughout the body. The problem involves an excessive outward curvature of the spine, compromising the upright posture of the patient causing impairment of the visual field, and subjection of the patient to extreme discomfort when seated in a wheelchair.

There are two recognised types of kyphosis, namely primary, wherein the spinal distortion is limited to the thoracic spine and a more advanced form in which the kyphosis has progressed to the lower spine.

Many solutions have been proposed in order to alleviate the problems associated with this disorder.

The commercially available wheelchair back supports, which are generally flat, display the following disadvantages. Although the patient's visual field is increased, gravitational forces pull the head downwardly as the neck muscles tire. As elbow support is compromised, the individual tends to lean more and more to one side. Furthermore, because the hips are thrust and slide forwardly, there is a propensity for the patient to slip out of the wheelchair. Additionally, there is a tendency for the feet to slip off the foot plates completely. A further discomfort arises due to the extreme pressure of the bony area of the back being pushed against the flat back support surface.

An alternative to the above-described prior art back support is to provide a recliner wheelchair. Initially, such a wheelchair allows improved skeletal alignment but deleteriously over prolonged seating provides no mechanism for retention of the initial positioning. Again, the pressure on the parent's back is centered on the apex of their kyphosis. Upon moving laterally so as to effect some relief of the pressure, the individual is inclined to lean further and further due to gravity. Alternatively, the sufferer may slide forward due to gravitational pull.

There exists, therefore, a need for a wheelchair back support functional to overcome and address the problems mentioned heretofore.

SUMMARY OF THE INVENTION

It is an objective of the present invention to provide a wheelchair back support adapted to specifically meet the requirements of a kyphotic patent. More specifically, the back support, because of its pliability, is functional to conform to the particular person using it, thereby diffusing the pressure over the entire affected spinal area.

Furthermore, it is an objective of the present invention to extend support to the unaffected area of the spine, mainly in the lumbar region.

In accordance with the present invention there is provided a wheelchair back adapted for a kyphotic patient which comprises an outer shell formed of a firm but pliable fabric. Exemplary fabrics would include plastic materials and the like. Preferably, the outer shell would be washable.

An inner foam padding is inserted within the outer shell. Two, longitudinally extending, resilient spaced-apart ribs are positioned at predetermined distances within the outer shell thereby dividing the back into three sections. The back is top stitched along its outer perimeter at a predetermined distance from the edge thereof to thereby achieve the required shape. Removable fasteners are inserted longitudinally at spaced apart intervals adjacent the outer edges of said back and are adapted to accommodate most standard wheelchairs.

Preferably, two embodiments of the wheelchair back support would be provided. The first back support would be high and adapted to accommodate a primary kyphosis, namely a kyphosis which is limited to the thoracic spine.

A second version would be a low back support which is adapted to accommodate a kyphosis that has progressed due to lumbar curvature. The terms "high" and "low", and the requisite dimensions thereof, will be self-evident to one skilled in the art.

Broadly stated the invention comprises an upholstered back support adapted for placement in a wheelchair formed of an integral unit defining three sections and particularly adapted for patients suffering from kyphosis which comprises an outer shell formed of a firm, pliable fabric, an inner foam padding positioned within the outer shell, two resilient ribs inserted between the outer shell at predetermined distances thereby dividing the back into three sections, top stitching along the perimeter of said back, and longitudinally along each edge of both ribs so as to provide permanence to the shape thereof and fasteners for removably attaching said back support to said wheelchair.

DESCRIPTION OF THE PREFERRED EMBODIMENT

Figure 1:
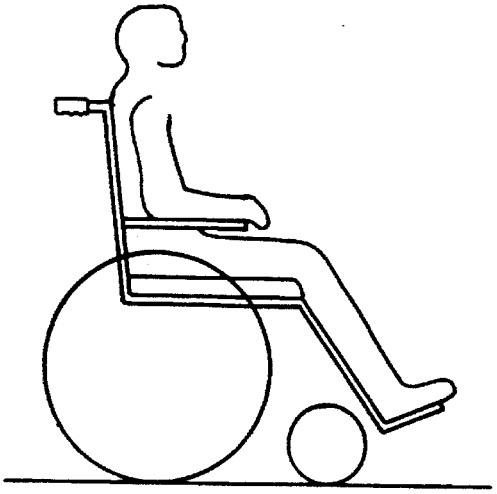
FIG. 1. (PRIOR ART)
FIG. 1 is a side view of a patient with normal posture sitting in a wheelchair using the prior art standard back support.
Figure 2:
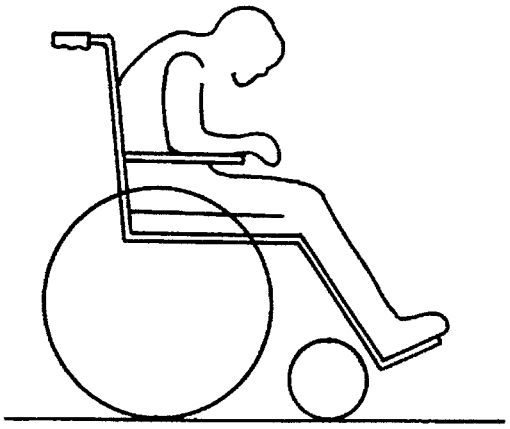
FIG. 2. (PRIOR ART)
FIG. 2 is a side view of a kyphotic patient displaying secondary kyphosis seated in a wheelchair provided with the back support of the prior art.
Figure 3:
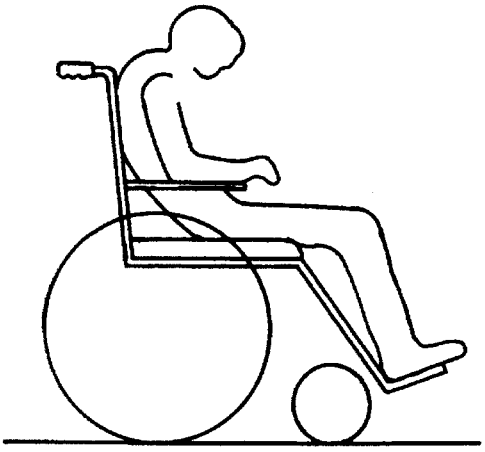
FIG. 3 (PRIOR ART)
FIG. 3 is a side view of a patient with primary kyphosis seated in a wheelchair utilizing the prior art back support.
Figure 4:
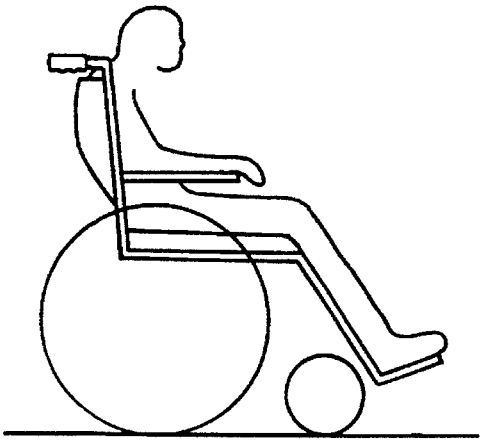
FIG. 4 is a side view of a kyphotic patient seated in a wheelchair wherein the back support of the instant invention is being used.
Figure 5:
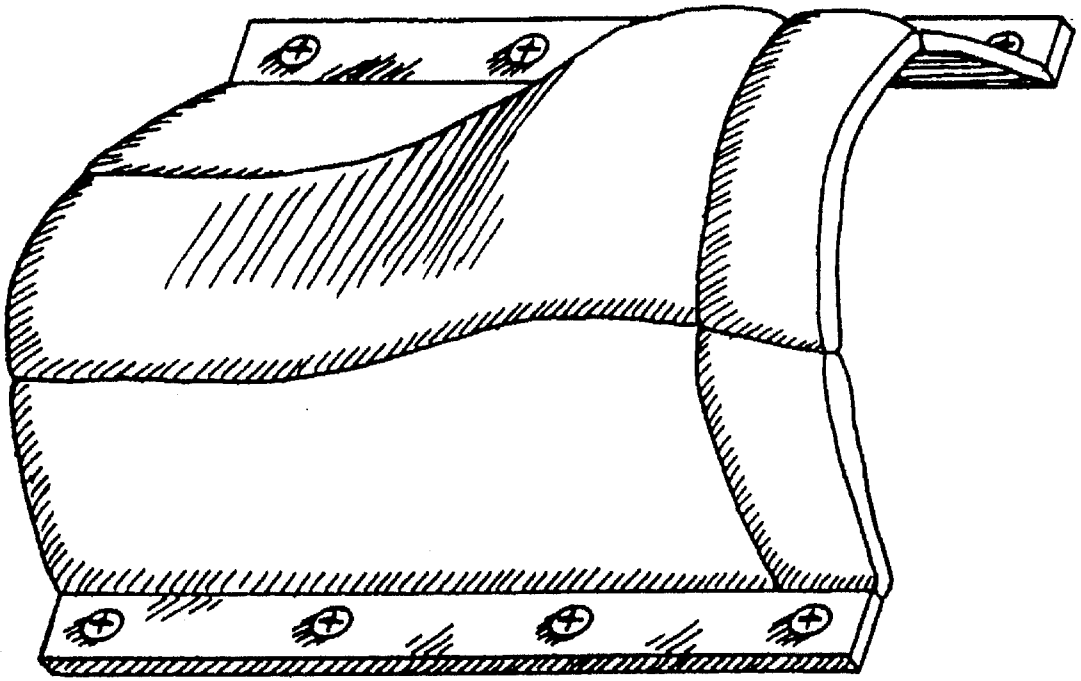
FIG. 5 is a perspective view of the wheelchair back support of FIG. 4.

Having reference to the accompanying drawings, there is provided the wheelchair back support 1.

The support 1 comprises an outer shell 2 formed of a pliable, plastic, washable fabric.

An inner foam pad 4 is fitted within the shell 2.

Positioned within the outer shell 2 are spaced apart, longitudinally extending ribs 6. The ribs 6 are formed of resilient plastic.

Top stitching 8 is provided along the perimeter of support 1 adjacent the edge thereof and along the longitudinal edges of ribs 6 to provide permanence to the shape of said support.

Fasteners 10, are provided which are adapted to mate with opposed fasteners (not shown) associated with the wheelchair 12.

The embodiments in which an exclusive privilege or property are claimed are defined by the claims which now follow:

1. An upholstered back support formed of an integral unit defining three sections and particularly adapted for placement in a wheelchair used by patients suffering from kyphosis and which comprises:

an outer shell formed of a firm, pliable fabric;

an inner foam padding positioned within the outer shell;

two resilient, longitudinally extending ribs inserted within the outer shell at predetermined spaced-apart distances thereby dividing the back support into three sections;

top stitching along the perimeter of said back support and longitudinally along an edge of each of said ribs so as to provide permanence to the shape thereof; and fasteners for removably attaching said back support to said wheelchair.

2. The back support as set forth in claim 1 which is located on the wheelchair to accommodate a primary kyphosis that is limited to the thoracic spine.

3. The back support as set forth in claim 1 which is located on the wheelchair to accommodate a kyphosis that has progressed due to lumbar curvature.

* * * * *